United States Patent [19]

Eskelinen

[11] Patent Number: 4,485,513

[45] Date of Patent: Dec. 4, 1984

[54] WASHING MACHINE FOR A WASTE CONTAINER

[75] Inventor: Kalevi Eskelinen, Vihtavuori, Finland

[73] Assignee: Vihta-Auto ja Kone Oy, Vihtavuori, Finland

[21] Appl. No.: 476,206

[22] Filed: Mar. 17, 1983

[30] Foreign Application Priority Data

Mar. 17, 1982 [FI] Finland ..... 820910

[51] Int. Cl.[3] ..... A47L 25/00; A46B 13/04

[52] U.S. Cl. ..... 15/56; 15/21 E; 15/71

[58] Field of Search ..... 15/21 E, 56, 57, 104.1 C, 15/21 R, 70, 71

[56] References Cited

U.S. PATENT DOCUMENTS 3,604,038 9/1971 Di Ilio ..... 15/56

*Primary Examiner*—Edward L. Roberts

*Attorney, Agent, or Firm*—Burns, Doane, Swecker & Mathis

[57] ABSTRACT

A washing machine for a waste container or for any other container of a relatively large size is designed so as to be attached preferably to a vehicle, such as a lorry, for example as a unit with a frame of an exchangeable platform. The washing machine (1) comprises at least one rotable brush (2), which consists of a tubular brush body (3), from which the brush fibres project preferably radially, and of nozzle means for spraying the washing liquid onto the object to be washed. According to the invention, for the purpose of moving the brush (2) along a path of movement substantially of a shape of a rectangle or square in the normal plane of the axis (4) of rotation of the brush, the washing machine (1) comprises guide means (5, 6) and a drive gear (7) for moving the brush (2) in the normal plane of its axis (4) in one direction back and forth. The washing machine (1) additionally comprises a second set of guide means (8, 9) and a drive gear (10) for moving the brush (2) in the normal plane of its axis (4) back and forth in a direction perpendicular to the direction mentioned above.

13 Claims, 4 Drawing Figures

WASHING MACHINE FOR A WASTE CONTAINER

The present invention is concerned with a washing machine for a waste container or for any other container of a relatively large size, the washing machine being designed so as to be attached preferably to a vehicle, such as a lorry, for example as a unit with a frame of an exchangeable platform, whereat the washing machine comprises at least one rotable brush, which consists of a tubular brush body, from which the brush fibres project preferably radially, and of nozzle means for spraying the washing liquid onto the object to be washed.

The objective of the invention is to permit mechanized washing of large containers of different sizes and different forms, and in particular washing of waste containers in a washing machine fitted onto a vehicle.

The washing machine in accordance with the invention is mainly characterized in that, for the purpose of moving the brush along a path of movement substantially of a shape of a rectangle or square in a plane perpendicular of the axis of rotation of the brush, the washing machine comprises guide means and a drive element for moving the brush in the normal plane of its axis in one direction back and forth and that the washing machine additionally comprises a second set of guide means and a drive gear for moving the brush in the normal plane of its axis back and forth in a direction perpendicular to the direction mentioned above.

According to the main embodiment of the invention, the washing machine is additionally characterized in that the brush is fitted close to the horizontal plane in an inclined position so that the free end of the brush is located higher than the root end of the brush with the brush-rotating motor, and that the brush is fitted so that it can be shifted by means of the drive gear along horizontal guides in a direction perpendicular to its axis of rotation as well as, as guided by guide means located in a plane perpendicular of the axis of rotation of the brush, by means of the drive element in a substantially vertical direction, as well as, additionally, along guides parallel to the axis of the brush, by means of the drive gear in the longitudinal direction of its axis.

Figure 1:
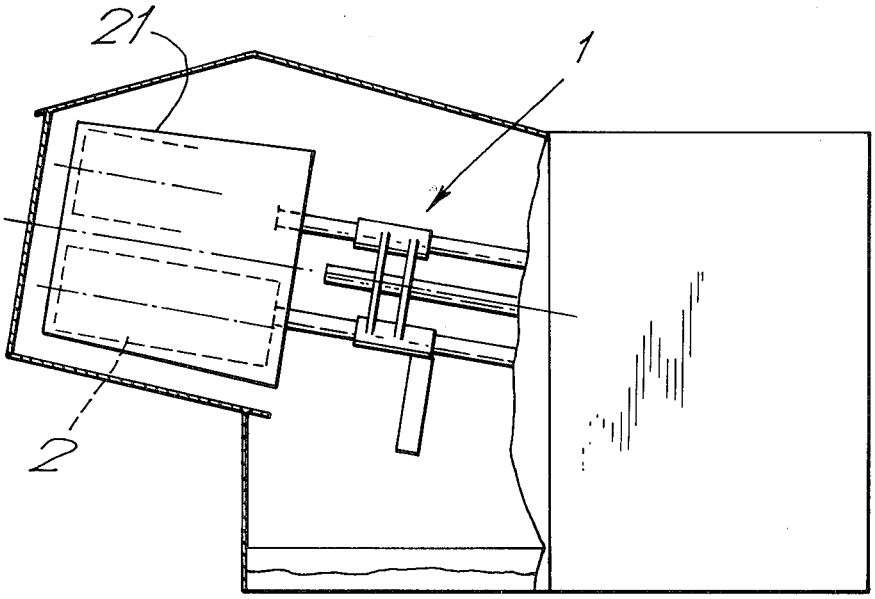
Figure 2:
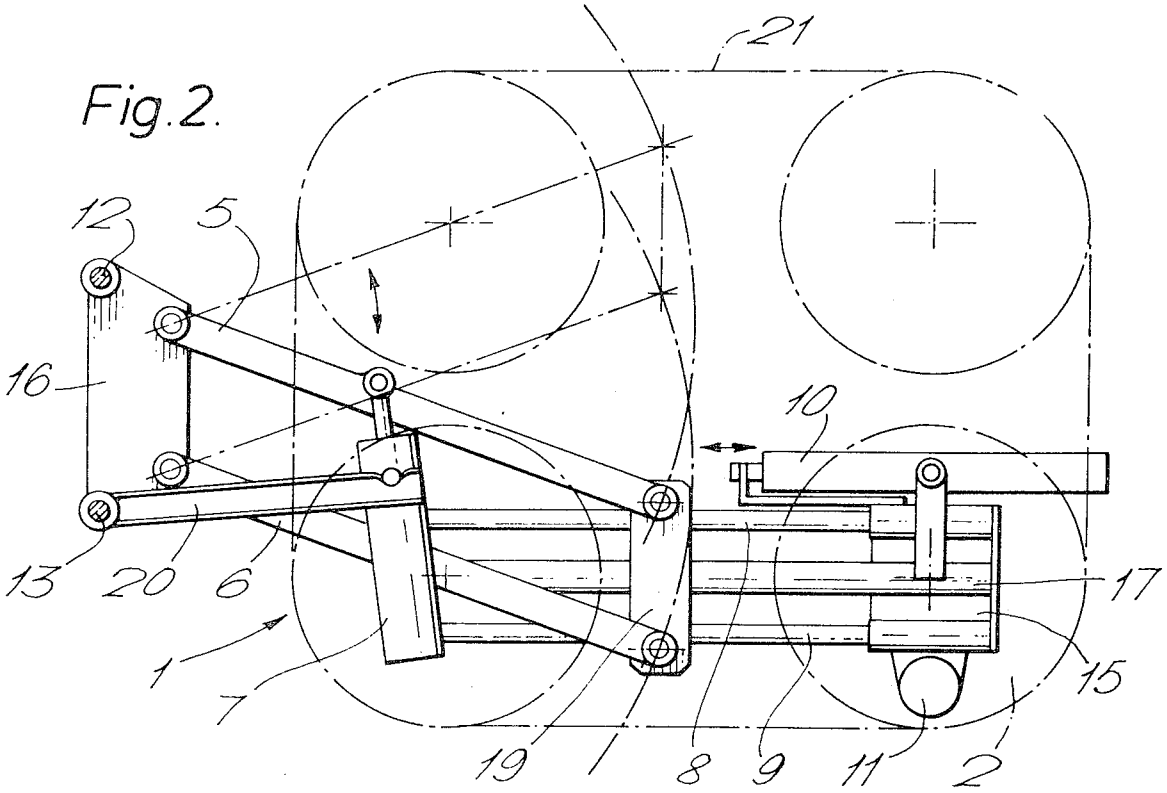
Figure 3:
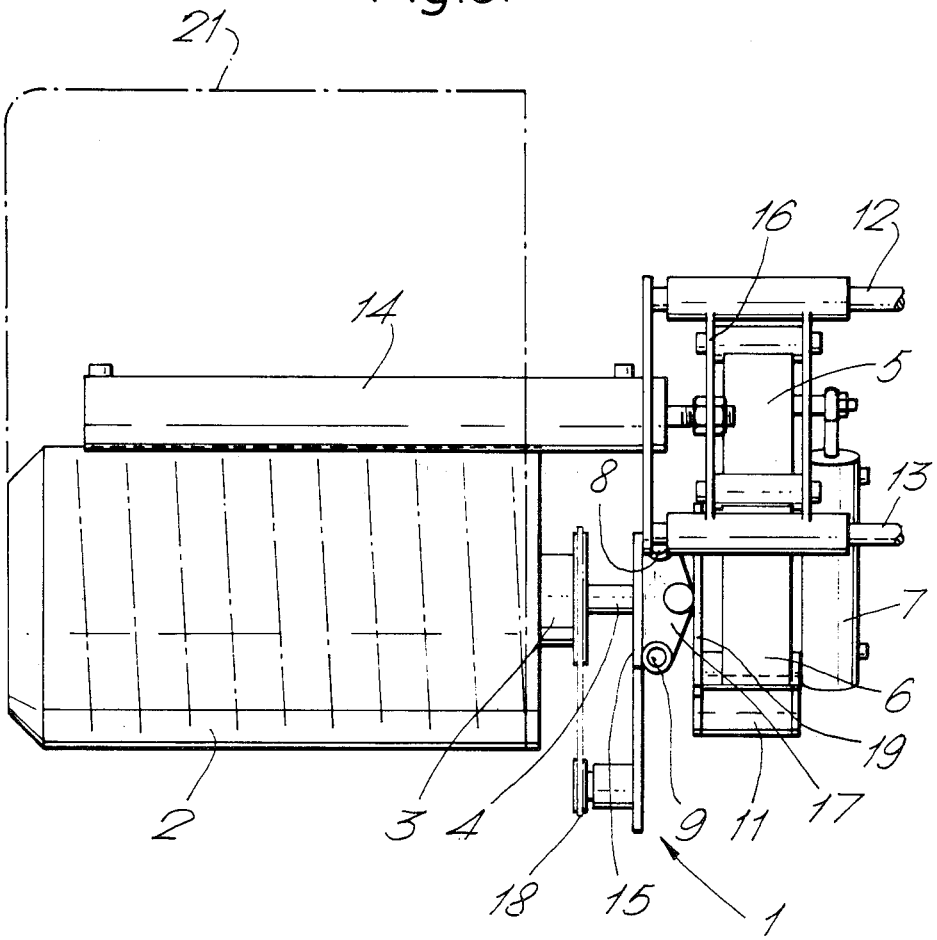
Figure 4:
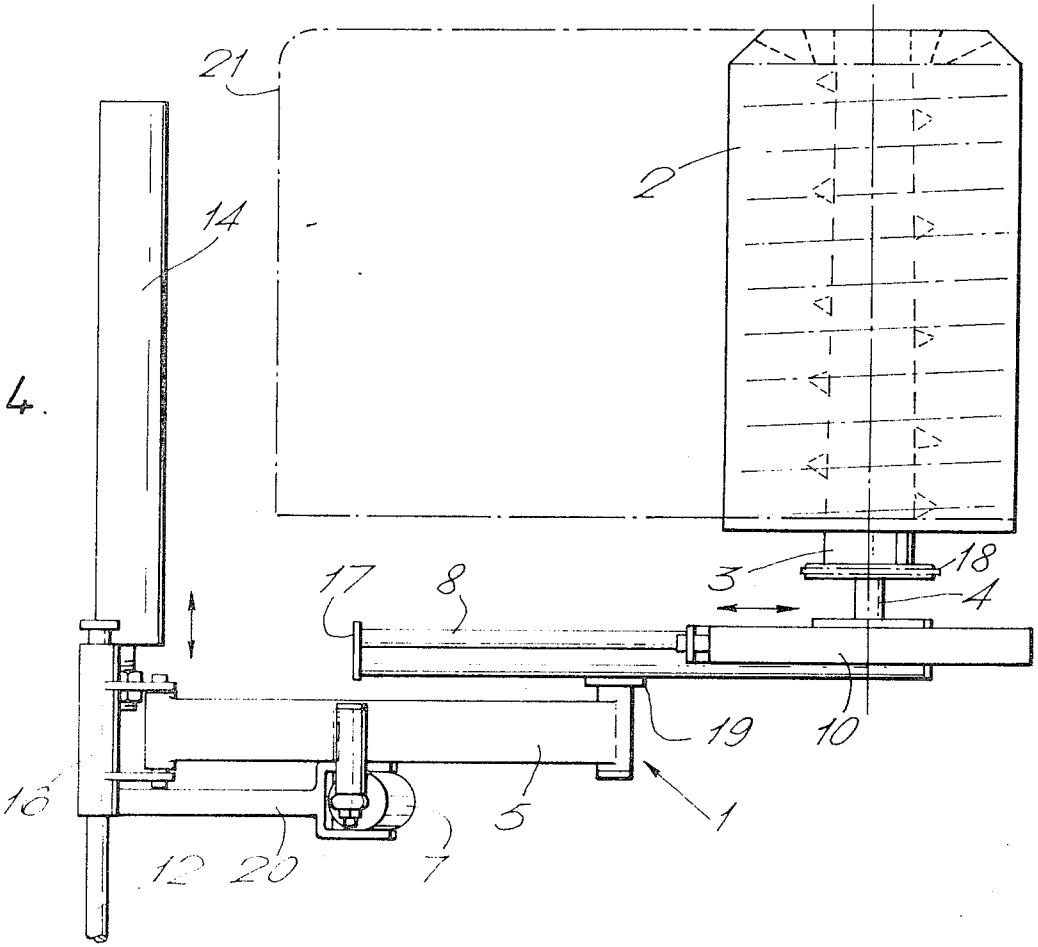

The invention comes out more closely from the following description and from the attached drawings, wherein FIG. 1 shows the process of washing of a container as a side view highly schematically, FIG. 2 shows the washing machine as viewed in the direction of the axis of rotation of the brush, FIG. 3 shows the washing machine as a side view, and FIG. 4 shows the washing machine as viewed from above in a direction perpendicular to the axis of rotation of the brush.

The washing machine 1 includes a brush 2 rotable in accordance with the figures, the said brush comprising a tubular brush body 3, from which the brush fibres, e.g. polypropylene fibres, project radially. The brush 2 with the tubular body 3 is mounted on a shaft 4, one of whose ends is attached to an auxiliary frame 15. A hydraulic motor 11 is also attached to the auxiliary frame 15, the brush 2 being rotated by the said hydraulic motor 11. A cogwheel is fitted on the shaft of the hydraulic motor 11, and a second cogwheel is located at the end of the tubular body 3 of the brush 2. An endless chain 18 is fitted as circulating around the said cogwheels.

Horizontal guides 8 and 9, which are parallel to each other and placed at a distance from each other, are connected to each other and to the frame 17 at both of their ends. A cylinder-piston device 10 is fitted between the frame 17 and the auxiliary frame 15, by means of which device 10 the auxiliary frame 15 can be shifted back and forth in the longitudinal direction of the horizontal guides 8 and 9. At the middle of the frame 17, a transverse frame piece 19 is attached, lever arms 5 and 6 being attached by means of articulated joints to the ends of the said piece 19. The opposite ends of the lever arms 5 and 6 are attached to a shifting plate 16 by means of articulated joints. The lever arms 5 and 6 are parallel to each other, and together with the frame piece 19 and the shifting plate 16 they form an articulated quandrangle. The axes of the articulated joints of the said articulated quadrangle are parallel to the shaft 4 of the brush 2 and perpendicular to the plane of the guides 8 and 9. The shifting plate 16 includes a projecting arm 20, being a part stationarily fixed to the plate, and a cylinder-piston device 7 is fitted by means of articulated joints between the outer end of the arm 20 and the lever arm 5. By means of the cylinder-piston device 7 and as guided by the lever arms 5 and 6, the brush 2 can be shifted in a plane perpendicular of the shaft 4 of the brush 2 in a direction substantially perpendicular to the horizontal guides 8 and 9. The paths of movement of the lever arms 5 and 6 come out from FIG. 2.

The shifting plate 16 is fitted as sliding on guides 12 and 13, which are parallel to each other and placed at a distance from each other. The guides 12 and 13 are parallel to the shaft 4 of the brush 2. The guides 12 and 13 are attached to the frame construction of the washing machine 1. Between the frame construction of the washing machine and the shifting plate 16, a cylinder-pistion device 14 is fitted, by means of which the shifting plate 16 can be shifted along the guides 12 and 13 in their longitudinal direction.

The cylinder-piston devices 7, 10 and 14, which constitute the drive elements moving the brush 2, may be hydraulically or pneumatically driven and controlled. Of course, instead of the cylinder-piston devices 7, 10 and 14, it is also possible to use other drive elements suitable for the purpose.

The washing machine 1 is intended especially for the washing of waste containers 21 or of other relatively large containers. The washing machine 1 may be fitted, e.g., permanently on the chassis construction of a lorry, or the washing machine 1 may be constructed as a unit with an exchangeable platform frame. When used in connection with a vehicle, the washing machine 1 is preferably fitted in accordance with the schematical presentation in FIG. 1 so that the brush 2 is fitted in a position inclined close to the horizontal plane. In such a case, the free end of the brush 2 is placed higher than the root end of the brush 2 with the rotating motor 11. If the washing machine is operated as an exchangeable platform unit, it is provided with snap joints for connection with the hydraulic system of the vehicle, from which the machine then receives its drive power. In connection with the washing machine, there must be a water tank, from which water is pumped by means of a pump through nozzles into the object to be washed. The washing water is passed into the container 21 through the tubular body 3 of the brush 2, whereat the nozzles are placed at the free end of the brush 2. Moreover, water is also sprayed onto the outer face of the container. From the bottom portion of the washing space, the washing water is recirculated by means of a suction pump back into the water tank, so that the same washing water is recirculated in the system during washing. The washing space contains water only during washing. The washing unit, of course, also comprises lifting equipment, i.e. a so-called container lift, by means of which the container 21 to be washed is lifted to the washing position into the closed washing space, and after completed washing again lowered onto the ground.

The washing machine 1 in accordance with the invention operates as follows. To begin with, the waste container 21 is attached to the container lift (not shown in the drawing), and the waste container 21 is raised by means of the container lift into the washing space of the washing machine to the washing position in accordance with FIG. 1. By means of the cylinder-piston device 14, the brush 2 is shifted along the guides 12 and 13 into the container 21 to be washed. When the washing program is started, the water pump starts spraying water from the water tank through the nozzles of the brush device into the container 21 to be washed, as well as through nozzles placed at the walls of the washing space onto the outer face of the container 21 to be washed. At the same time, the suction pump starts pumping the water gathered on the bottom of the washing space back into the water tank. The hydraulic motor 11 rotates the brush 2 by means of the chain 18, and during the washing process the brush 2 is guided alternatingly by means of the cylinder-piston devices 7 and 10 so that the brush 2 moves as guided by the lever arms 5 and 6 and by the guides 8 and 9 in a plane perpendicular of the shaft 4 of the brush 2 along a path of substantially rectangular or square form. The said path of movement of the brush 2 is shown in FIG. 2. The brush 2 may be guided so as to circulate once or several times around its said rectangular or square path of movement. On completion of the washing process, the spraying of water is stopped and the brush 2 is shifted out of the container 21 by means of the cylinder-piston device 14 along guides 12 and 13, and finally the container is lowered out of the washing space by means of the container lift.

The washing machine 1 may be constructed so that the guide means and the cylinder-piston devices 7, 10 and 14, which constitute the drive gears, are so dimensioned that by their means such a path of movement is produced for the brush 2 as is suitable for a container 21 of an exactly specified type. The washing machine 1 is, however, preferably automated so that by means of the washing machine it is possible to wash containers of several different sizes and shapes. In such a case, the automatic operation may be arranged, e.g., pneumatically so that the equipment feels the walls of the container at each particular time to be washed, and controls itself accordingly.

What is claimed is:

1. A washing machine for a waste container or for any other container of a relatively large size, the washing machine being designed so as to be attached preferably to a vehicle, such as a lorry, for example as a unit with a frame of an exchangeable platform, the washing machine comprises at least one rotatable brush, which consists of a tubular brush body, from which the brush fibers project preferably radially, and of nozzle means for spraying the washing liquid onto the object to be washed, wherein, the brush is moved along a path of movement substantially of a shape of a rectangle or square in a plane perpendicular to the axis of rotation of the brush, the washing machine comprises a first guide means and a first drive element for moving the brush in a plane perpendicular to the axis in a first direction, the washing machine additionally comprises a set of horizontal guide means and a second drive element for moving the brush in a plane perpendicular to the axis back and forth in a second direction perpendicular to the first direction.

2. A washing machine as claimed in claim 1, wherein the brush is close to a horizontal plane in an inclined position so that a free end of the brush is located higher than a root end of the brush driven with a brush-rotating motor, and that the brush is shiftable by means of the second drive element along said horizontal guides in a direction perpendicular to the axis of rotation as well as guided by said first guide means located in the plane perpendicular to the axis of rotation of the brush, by means of the first drive element in a substantially vertical direction, as well as along shifting device guides parallel to the axis of the brush, by means of a third drive element in the longitudinal direction of the axis.

3. A washing machine as claimed in claim 2, wherein the shifting device guides parallel to the axis of rotation of the brush have been fixed in relation to the frame construction of the washing machine unit.

4. A washing machine as claimed in claim 3 wherein the brush with the rotating motor is attached to an auxiliary frame, which is movable by means of the second drive element along the horizontal guides.

5. A washing machine as claimed in claim 2, wherein the brush with the rotating motor is attached to an auxiliary frame, which is movable by means of the second drive element along the horizontal guides.

6. A washing machine as claimed in claim 5, wherein said first guide means placed in the plane perpendicular to the axis of rotation of the brush consist of a set of lever arms in the form of an articulated quadrangle, in which first ends of two parallel lever arms have been attached by means of articulated joints to a shifting plate moving along said shifting device guides parallel to the axis of the brush, and opposite ends have been attached to the frame supporting the horizontal guides.

7. A washing machine as claimed in claim 2, wherein the axis of rotation of the brush is in the vertical plane in the longitudinal direction of the vehicle.

8. A washing machine as claimed in claim 2, wherein the first, second and third drive elements moving the brush consist of hydraulically or pneumatically driven and controlled cylinder-piston devices.

9. A washing machine as claimed in claim 8, wherein the brush with the rotating motor is attached to an auxiliary frame, which is movable by means of the second drive element along the horizontal guides.

10. A washing machine as claimed in claim 2, wherein the brush with the rotating motor is attached to an auxiliary frame, which is movable by means of the second drive element along the horizontal guides.

11. A washing machine as claimed in claim 1, wherein the first and second drive elements moving the brush consist of hydraulically or pneumatically driven and controlled cylinder-piston devices.

12. A washing machine as claimed in claim 11, wherein the brush with a rotating motor is attached to an auxiliary frame, which is movable by means of the second drive element along the horizontal guides.

13. A washing machine as claimed in claim 1, wherein the brush is movable in the direction of the axis of the brush back and forth along said shifting device guides by means of a third drive element.

* * * * *